US010615472B2

(12) United States Patent
Hauff

(10) Patent No.: US 10,615,472 B2
(45) Date of Patent: Apr. 7, 2020

(54) FEED POLARIZER STEP TWIST SWITCH

(71) Applicant: Raytheon Company, Waltham, MA (US)

(72) Inventor: John W. Hauff, Marlborough, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/915,377

(22) Filed: Mar. 8, 2018

(65) Prior Publication Data

US 2019/0280357 A1 Sep. 12, 2019

(51) Int. Cl.

| | |
|---|---|
| ***H01P 1/165*** | (2006.01) |
| ***H01P 1/02*** | (2006.01) |
| ***H01P 1/06*** | (2006.01) |
| ***H01P 3/127*** | (2006.01) |
| ***H01P 1/17*** | (2006.01) |
| ***H01P 5/02*** | (2006.01) |

(52) U.S. Cl.

CPC ..... *H01P 1/165* (2013.01); *H01P 1/022* (2013.01); *H01P 1/062* (2013.01); *H01P 1/065* (2013.01); *H01P 1/17* (2013.01); *H01P 3/127* (2013.01); *H01P 5/024* (2013.01)

(58) Field of Classification Search

CPC ..... H01P 1/165; H01P 1/022; H01P 1/062; H01P 3/127

USPC ..... 333/21 A

See application file for complete search history.

(56) References Cited

U.S. PATENT DOCUMENTS

| | | | |
|---|---|---|---|
| 3,001,159 | A | 9/1961 | Hilsinger, Jr. |
| 3,024,463 | A | 3/1962 | Moeller et al. |
| 5,781,087 | A | 7/1998 | Milroy et al. |
| 6,677,911 | B2 | 1/2004 | Moheb |

(Continued)

FOREIGN PATENT DOCUMENTS

JP S5481056 A 6/1979

OTHER PUBLICATIONS

PCT International Search Report dated Apr. 18, 2019 for International Application No. PCT/US2019/015501; 9 Pages.

(Continued)

*Primary Examiner* — Robert J Pascal
*Assistant Examiner* — Kimberly E Glenn
(74) *Attorney, Agent, or Firm* — Daly, Crowley, Mofford & Durkee, LLP

(57) ABSTRACT

A polarizer apparatus for RF communications including an in-line waveguide switch having a first port with a rectangular waveguide shape, and a second port having a circular waveguide shape. The waveguide switch includes a plurality of rotatable disks coupled and arranged between the input and output of said waveguide switch, each of the disks having an opening provided therein which defines at least a portion of a signal path configured to allow RF signals to propagate therethrough. The waveguide switch includes an actuating mechanism arranged to rotate the disks to positions relative to each other which modify the polarization of RF signals propagating through the openings. The polarizer apparatus includes a feed coupled to the output of the waveguide switch, the feed including a vane polarizer arranged to circularly polarize signals provided thereto from the output of the waveguide switch.

27 Claims, 8 Drawing Sheets

(56) References Cited

U.S. PATENT DOCUMENTS

| | | | | |
|---|---|---|---|---|
| 6,720,840 | B2 * | 4/2004 | Bohnet | H01P 1/065 333/21 A |
| 7,236,681 | B2 | 6/2007 | Moheb et al. | |
| 2011/0133863 | A1 | 6/2011 | Lange | |
| 2012/0169557 | A1 | 7/2012 | Naym et al. | |

OTHER PUBLICATIONS

PCT International Written Opinion dated Apr. 18, 2019 for International Application No. PCT/US2019/015501; 10 Pages.

* cited by examiner

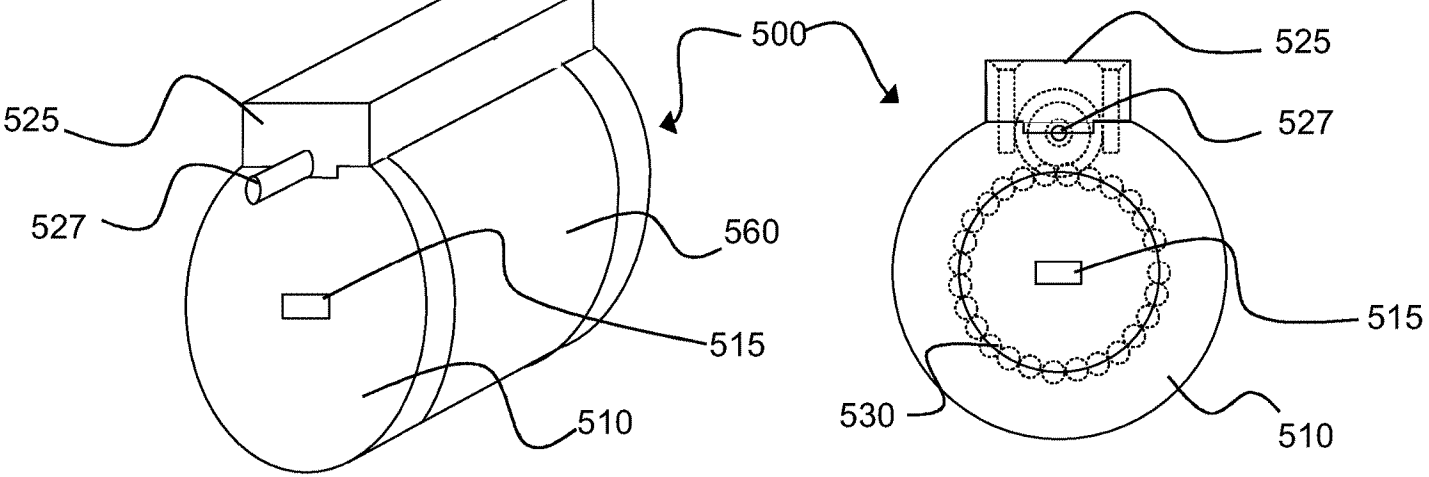
FIG. 5B
FIG. 5A
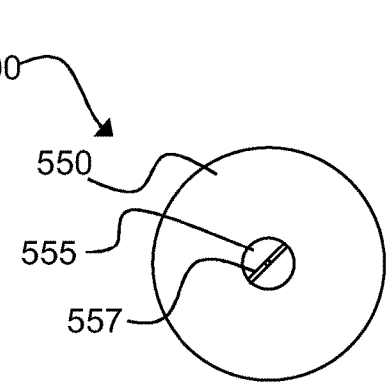
FIG. 6B
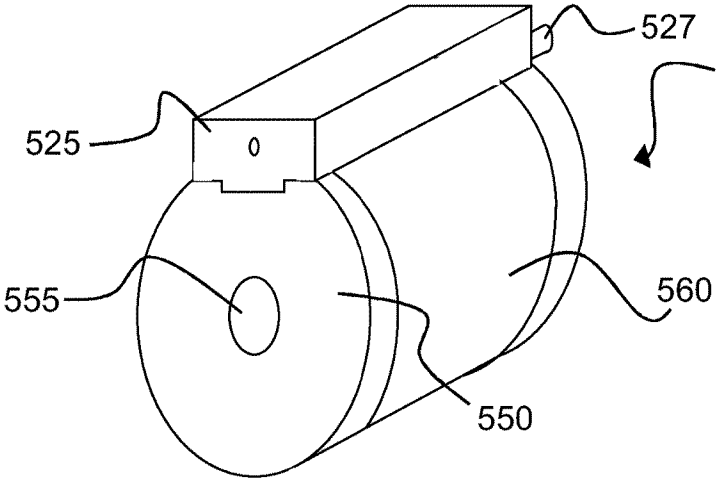
FIG. 6A

FEED POLARIZER STEP TWIST SWITCH

BACKGROUND

Many communication transmission systems, including those for many airborne and ship based satellite systems, need to support multiple RF bands and multiple signal polarizations. For example, some systems need to support two frequency bands where one band can utilize either right and left hand circular polarizations while the other band might only use left hand circular polarization, or only right hand polarization. In other cases where linear polarization is used, the polarization angle into the feed requires frequent adjustment to compensate for platform movement. Linearly polarized signals may need to be either vertically or horizontally polarized based on what satellite resources are available.

Many systems typically do not need to utilize all of the different configurations simultaneously and have been manufactured to switch between configurations so as to minimize cost, weight, and footprint constraints that can be critical when deployed in mobile platforms (e.g., shipboard, aircraft). Any additional hardware needed to provide the switching capability takes valuable space and also must be counterweighted for antenna balance. In some instances, twice the volume is required to implement a multiple configuration capability due to the counterweights.

Some current systems utilize a diplexer on the input to the feed, a waveguide switch, and multiple waveguide sections separately configured to conform with different wavelengths (e.g., waveguide dimensions) to interconnect the switch to the diplexer. Accurate and stable arrangements of the waveguides may thus be necessary so as to avoid unacceptable signal loss (e.g., insertion loss of the transmit path). In yet other implementations, phase matching of the signal paths is needed, which can also introduce further complexity, footprint, and cost.

For example, FIG. 1 is an illustrative block diagram of an exemplary switching system 100. An input waveguide 105 transmits a signal to a "baseball switch" 120. Switch 120 can be configured to polarize a signal through the system 100 by being rotated (depending on the anticipated frequency band and polarization) and thereby connecting the input waveguide 105 with either one of two ports of a diplexer 130 through waveguide 127 or waveguide 125, which are configured to conform with different bands of RF signals, respectively. In this type of configuration, the linear polarization of the signal is determined by the diplexer 130. The signal is subsequently transmitted through the circular polarizer 135 and then to antenna feed horn 140. A drive motor 165 can be utilized to rotate the "baseball switch" 120. This implementation can be very bulky and also will likely need to be counterweighted for proper antenna balance.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments provide apparatus, methods, and systems for RF polarizer step twist switches.

In an aspect of embodiments, a polarizer apparatus for RF communications includes a waveguide step twist switch having a first port with a rectangular waveguide shape, and a second port having a circular waveguide shape, the waveguide switch including a plurality of rotatable disks coupled and arranged between the input and output of the waveguide switch, each of the disks having an opening provided therein which defines at least a portion of a signal path configured to allow RF signals to propagate therethrough, an actuating mechanism arranged to rotate the disks to positions relative to each other which modify the polarization of RF signals propagating through the openings, and a feed coupled to the output of the step twist switch, the feed comprising a vane polarizer arranged to provide an output polarization of signals provided thereto from the output of the waveguide switch.

In an embodiment, the arrangements of the disks create different polarizations for different bands of RF frequencies.

In an embodiment, the output polarization of signals is at least one of left hand circular polarization or right hand circular polarization.

In an embodiment, the disk openings are provided having a rectangular shape.

In an embodiment, one of the rotating disks includes a transition section that transitions substantially smoothly along its length from a rectangular input to a circular output.

In an embodiment, the disk openings can be rotated to gradually transition by about ninety degrees between a proximate disk opening and a distal disk opening.

In an embodiment, the disks further comprise RF chokes arranged about the openings.

In an embodiment, the actuating mechanism engages a series of coupled gears, wherein in response to a movement of the actuating mechanism, each of the gears rotates a corresponding disk at a different degree of rotation.

In an embodiment, the plurality of rotatable disks includes at least three rotatable disks.

In an aspect of embodiments, a rotating step twist waveguide includes a first stationary rectangular waveguide section having a first end corresponding to an input port of the rotating step twist waveguide and a second end, a first twist rectangular waveguide section having a first end coupled to the second end of said first stationary rectangular waveguide section and having a second end, an intermediate twist rectangular waveguide section having a first end coupled to the second end of said first twist rectangular waveguide section and having a second end, a distal twist rectangular to circular waveguide transition having a first end coupled to the second end of said intermediate twist rectangular waveguide section and having a second end, and a stationary circular waveguide section having a first end coupled to the second end of said distal twist rectangular to circular waveguide transition and having a second end corresponding to an output.

In an embodiment, the output is coupled to a feed structure comprising a vane polarizer.

In an aspect of embodiments, a method for polarizing RF communication signals includes providing a waveguide switch having a first port with a rectangular waveguide shape, and a second port having a circular waveguide shape, the waveguide switch comprising a plurality of rotatable disks coupled and arranged between the input and output of said waveguide switch, each of the disks having an opening provided therein which defines at least a portion of a signal path configured to allow RF signals to propagate therethrough, providing a feed coupled to the output of the waveguide switch, the feed comprising a vane polarizer arranged to provide circular polarization of signals provided thereto from the output of the waveguide switch, receiving an input RF signal through the input of the waveguide switch, based upon the type of input RF signal and a targeted polarization of an output signal, arranging the plurality of rotatable disks to one of a plurality of step switch rotations through which the input RF signal is configured to propagate through, and transmitting an output RF signal of the targeted polarization from the output of the waveguide switch.

In an embodiment, the different arrangements of the disks polarize different bands of RF frequencies.

In an embodiment, the disk openings are provided having a rectangular shape. In an embodiment, the rectangular shape transitions substantially smoothly across a portion of its length to a circular shape at the output of the waveguide switch.

In an embodiment, the rectangular openings are arranged to gradually transition by about ninety degrees between a proximate disk opening and a distal disk opening.

In an embodiment, the disks further comprise RF chokes arranged about the gaps between the disks.

In an embodiment, the actuating mechanism engages a series of coupled gears, wherein in response to a movement of said actuating mechanism, each of the gears rotates a corresponding disk at a different degree of rotation.

In an embodiment, the plurality of rotatable disks comprises at least three rotatable disks.

BRIEF DESCRIPTION OF THE DRAWING FIGURES

Other aspects, features, and advantages of the claimed invention will become more fully apparent from the following detailed description, the appended claims, and the accompanying drawings in which like reference numerals identify similar or identical elements. Reference numerals that are introduced in the specification in association with a drawing figure may be repeated in one or more subsequent figures without additional description in the specification in order to provide context for other features. Furthermore, the drawings are not necessarily to scale, emphasis instead being placed on the concepts disclosed herein.

FIG. 5A is an illustrative front facing perspective view of a polarization step switching system according to embodiments.

FIG. 5B is an illustrative front facing view of a polarization step switching system showing various internal features according to embodiments.

FIG. 6A is an illustrative rear facing perspective view of a polarization step switching system according to embodiments.

FIG. 6B is an illustrative rear facing view of a polarization step switching system according to embodiments.

DETAILED DESCRIPTION

Described embodiments are directed to apparatus and systems for feed polarizer step twist switches.

Figure 1:
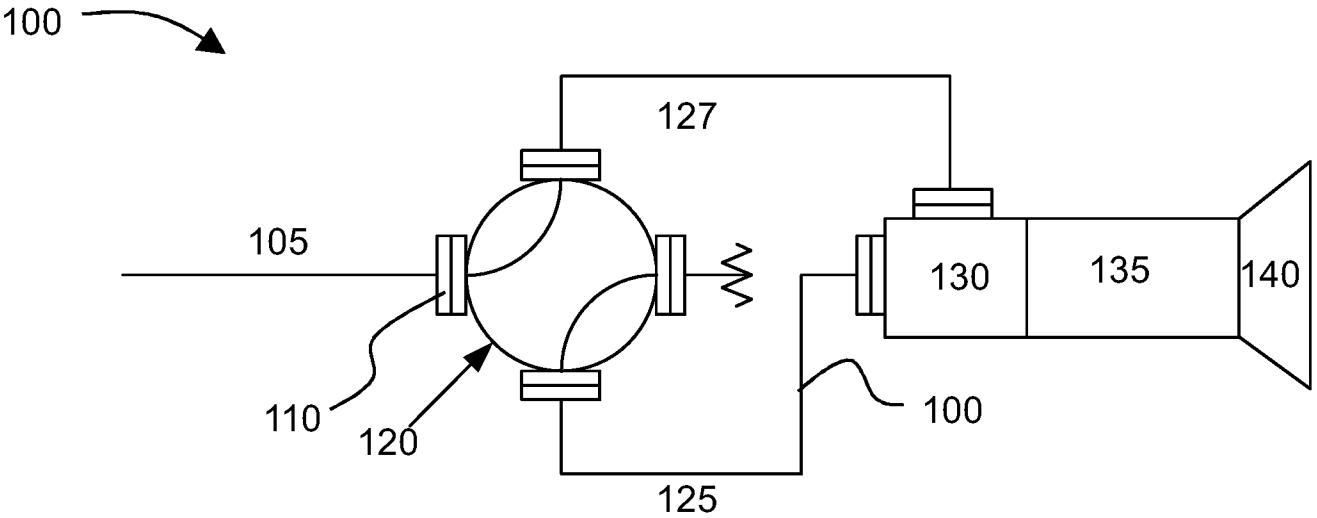
FIG. 1 (Prior Art)
FIG. 1 is an illustrative block diagram of an RF switching system.
Figure 2:
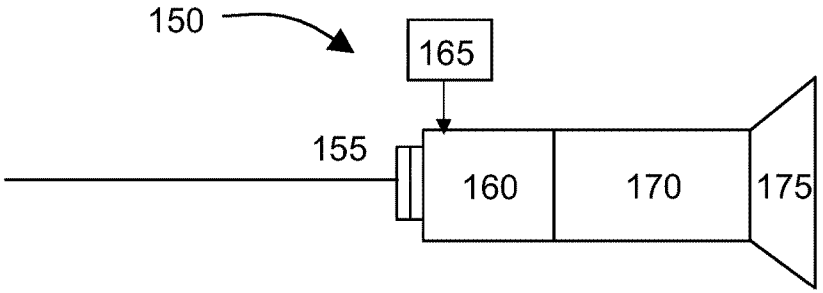
FIG. 2 is an illustrative block diagram of a polarization step switching system according to embodiments.

Referring to FIG. 2, an illustrative block diagram of a polarization step switching system 150 according to embodiments is shown. A waveguide 155 leads to the port of polarizer step switch 160, which is further connected to a circular polarizer 170 and to a feed horn 175. An actuator 165 (e.g., a drive motor) is connected to the step switch 160 and configured to drive a step switching mechanism to rotate twistable segments within step switch 160 such as further described in embodiments herein. Depending on how the twistable segments are twisted, a signal passing through step switch 160 and circular polarizer 170 will polarize a signal passing from waveguide 155 and distribute the resulting signal out of the feed horn 175.

Figure 3:
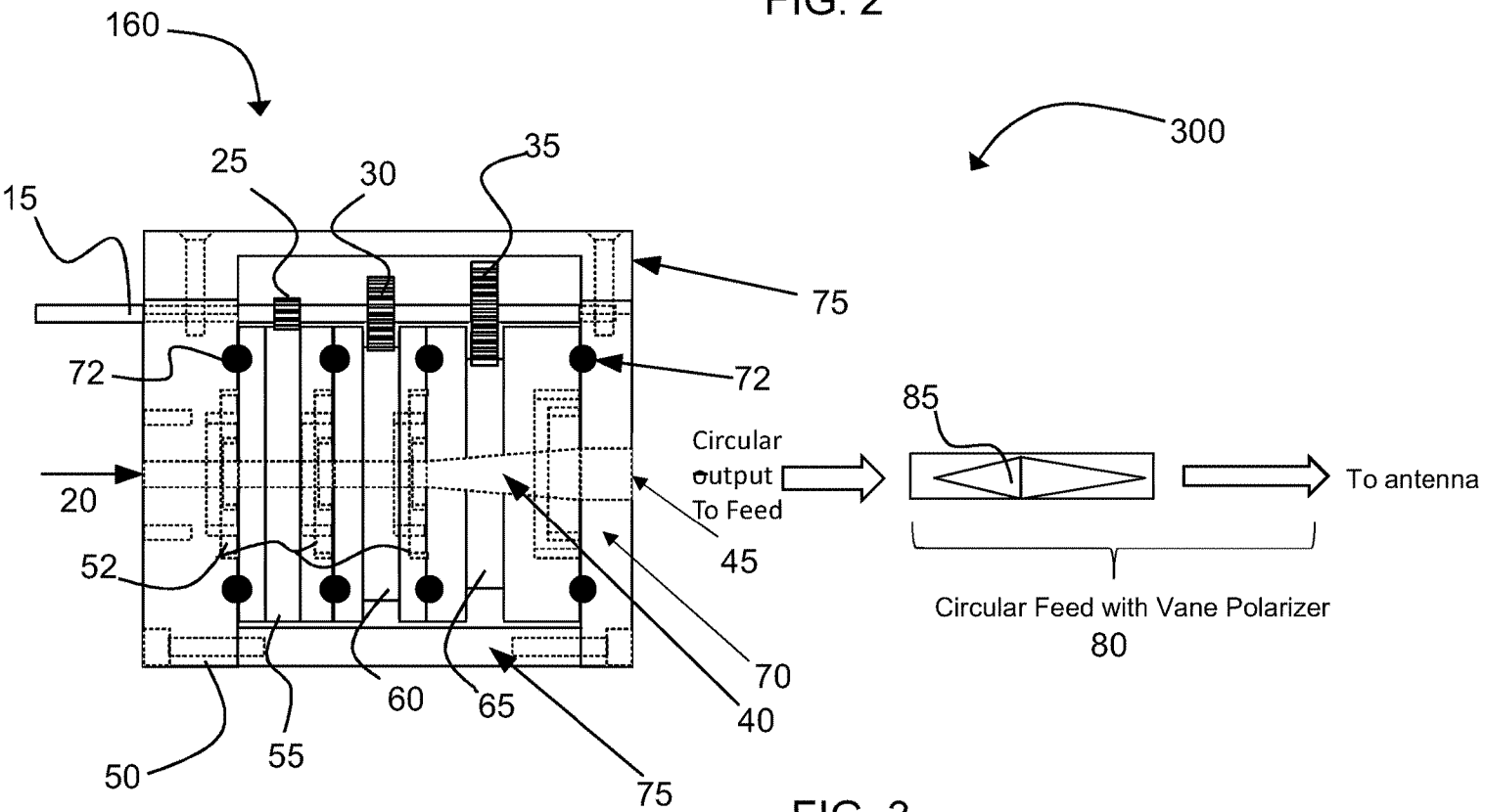
FIG. 3 is an illustrative cross-sectional view of a polarization step switch system according to embodiments.

Referring to FIG. 3, an illustrative cross-sectional view of a polarization step switch system 300 is shown according to embodiments. A step switch 160 includes several twistable waveguide sections (e.g., disks) 55, 60, and 65 that can be twisted by a drive mechanism (e.g., actuator 165) by way of a drive shaft 15, which can turn gears 25, 30, and 35, which are movably coupled to the twistable waveguide sections 55, 60, and 65, respectively, and with each other by way of the common drive shaft 15. Thrust bearings 72 provide a mechanical interface between the movable waveguide sections 55, 60, and 65 and stationary sections 50 and 70. Stationary sections 50 and 70 [item 70 is still incorrect. It is the part of the design which has item 45 going through it. Item 70 is the portion of the design to the right of the rightmost thrust bearings. It has a phantom screw holding it in place to item 75 at the top and bottom] as well as an outer housing section 75 frame and support the step switch 160.

In embodiments, the gears 25, 30, and 35 can be individually configured to simultaneously rotate the waveguide sections 55, 60, and 65 at different rates of rotation (e.g., by configuring the diameter/thread count of the gears 25, 30, and 65 accordingly). In embodiments, a predetermined rotational position of drive shaft 15 corresponds to predetermined rotational positions of the waveguide sections 25, 30, and 65 so as to polarize a type of signal passing therethrough with a predetermined overall linear polarization of an output signal. In embodiments, a rotational position of the drive shaft 15 corresponds to a gradually increased, relative twisting of the twistable waveguide sections 55, 60, and 65 (see, e.g., FIG. 10C). The gradual twisting can help to avoid signal loss between the twistable waveguide sections. In embodiments, any number of twistable waveguide sections can be utilized, however, as the numbers of such sections increase, the complexity and cost of the system does also.

In an embodiment, RF chokes 52 are included to effectively create RF shorts across the gaps between the disks so as to minimize loss and potential leakage into the gaps across the junctions.

In an embodiment, the shape of the waveguide cross section perpendicular to the central axis of the waveguide core 20 formed by the twistable sections is of a rectangular shape such as to match a rectangular RF input waveguide. In an embodiment, the waveguide core 20 gradually shifts across a segment 40 to a circularly shaped cross section as it extends to an output 45 (see, e.g., FIGS. 10B-10C) followed by a feed.

As similarly described above with reference to polarizer section 170 of FIG. 2, the output 45 of the step switch 160 leads to a circular feed 80, which is configured to provide a connection with an RF antenna (not shown), thereby communicating a signal that is polarized in the desired manner. In an embodiment, the circular feed 80 includes a vane polarizer 85. In embodiments, other polarizers that can be utilized include, for example, septum polarizers in which case an incoming wave could be rotated 180 degrees. In embodiments, the resulting polarization of an input signal distributed from the circular feed can be, for example, left circularly polarized or right circularly polarized, depending on the position of the twistable sections 55, 60, and 65. In an embodiment, the vane polarizer creates a circular polarization creating a wave that travels in a similar manner to a helix that rotates as the wave advances. In this manner, the polarization of the switch need not be continuously updated to compensate for a moving platform.

Figure 4A:
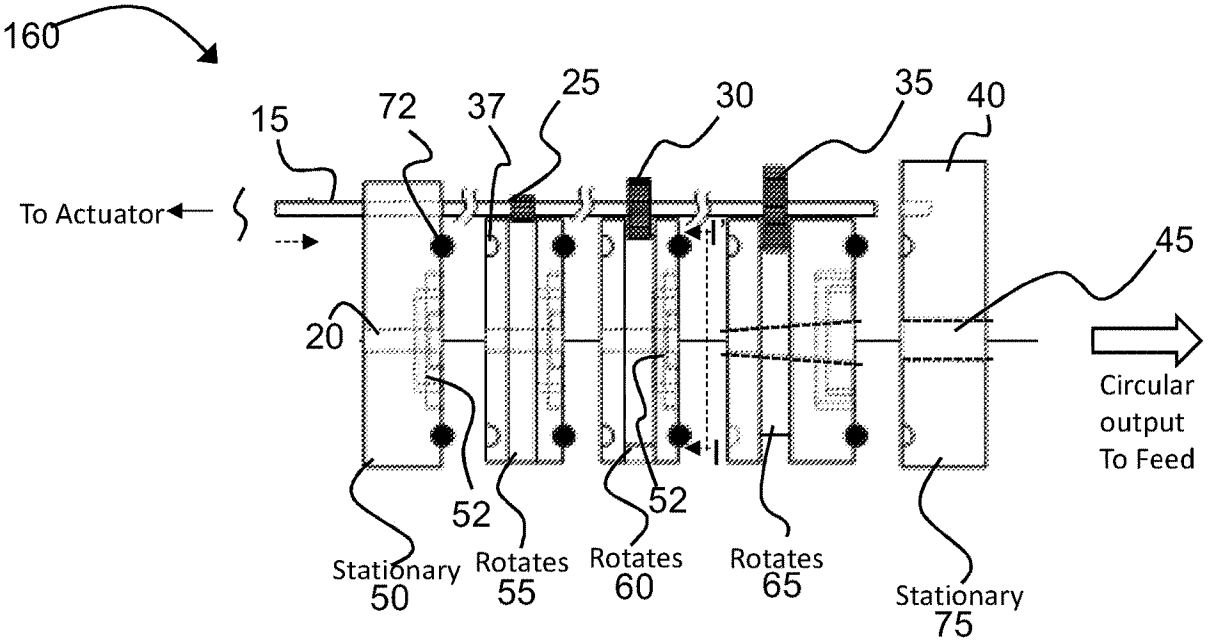
FIG. 4A is an illustrative blown-up view of interconnected segments of the polarization step switch of FIG. 3.
Figure 4B:
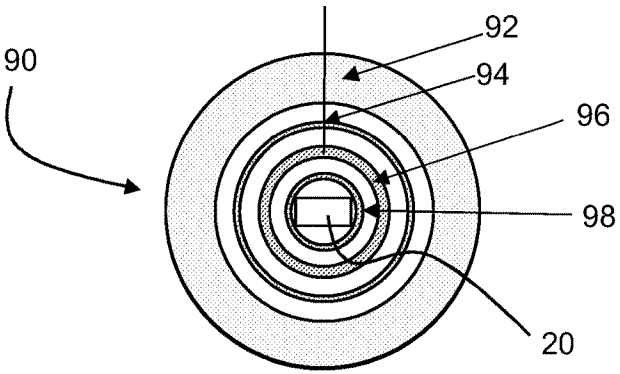
FIG. 4B is an illustrative cross-sectional view across section line I-I' of the polarization step switch shown in FIG. 4A according to embodiments.

Referring to FIG. 4A, an illustrative blown-up view of interconnected segments of the polarization step switch 160 of FIG. 3 is shown according to embodiments. FIG. 4B is an illustrative cross-sectional view 90 across section line I-I' of the polarization step switch 160 shown in FIG. 4A. A bearing race 92 provides a surface for the bearings 72 to engage with while the twistable sections 55, 60, and 65 rotate with respect to each other and stationary segments 50 and 75. RF choke elements 94, 96, and 98 correspond to RF chokes 52 and can provide proper RF shorting of the interfaces between the disks as to minimize loss and leakage, and can be configured as described above depending on the frequency band(s) utilized.

Referring to FIG. 5A, an illustrative perspective view of a polarization step switching system 500 is shown according to embodiments. FIG. 5B is an illustrative front facing see through view of the polarization step switching system 500 according to embodiments. A front facing side 510 of the system 500 includes an RF IO port 515. In an embodiment, port 515 is rectangular-shaped (e.g., adapted for an RF rectangular waveguide). In embodiments, other shapes can be utilized and include, for example, ridged waveguides. A driving mechanism (not shown), enclosed by a housing 525, is driven by a drive shaft 527 which can be connected to an actuator such as further described in embodiments herein, and drive the twisting of rotatable sections (e.g. rotatable disks of FIGS. 3-4) within a section 560. Race bearings 530, shown through side 510, provide an interface between stationary and rotating surfaces.

Referring to FIG. 6A, an illustrative perspective view of a polarization step switching system 500 is shown according to embodiments. FIG. 6B is an illustrative rear facing view of the polarization step switching system 500 according to embodiments. A rear facing side 550 of the system 500 includes an output 555. In an embodiment, the output 555 is circular and can be coupled to a feed through a vane polarizer (e.g., feed 170 of FIG. 2). In an embodiment, the orientation of a vane polarizer 557 is shown to illustrate how the step twist switch may work in conjunction with the vane polarizer.

Figure 7A:
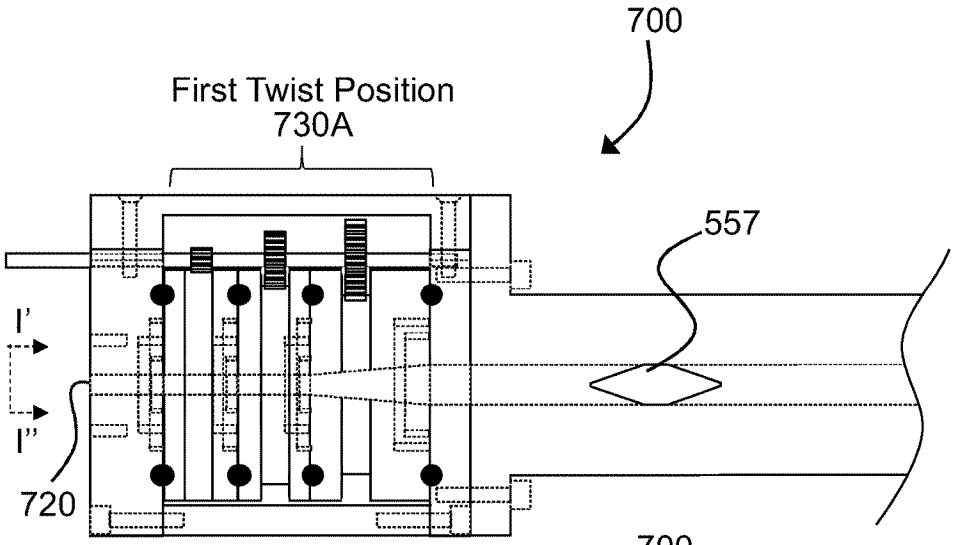
FIG. 7A is an illustrative cross-sectional view of a polarization step switching system in a first twist position according to embodiments.
Figure 7B:
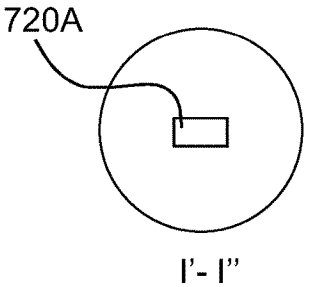
FIG. 7B is an illustrative front view across section line I-I' of the polarization step switching system shown in FIG. 7A.

Referring to FIG. 7A, an illustrative cross-sectional view of a polarization step switching system 700 in a first twist position is shown according to embodiments. FIG. 7B is an illustrative cross-sectional view across section line I-I' of the polarization step switching system 700 shown in FIG. 7A. In a first twist position, step twist segments across a section 730A are in an untwisted first position (see, e.g., FIG. 10B showing an illustrative perspective view of step twist segments in an untwisted first position). The view 720A through an IO port 720 to rotatable segments therethrough thus appears untwisted.

Figure 8A:
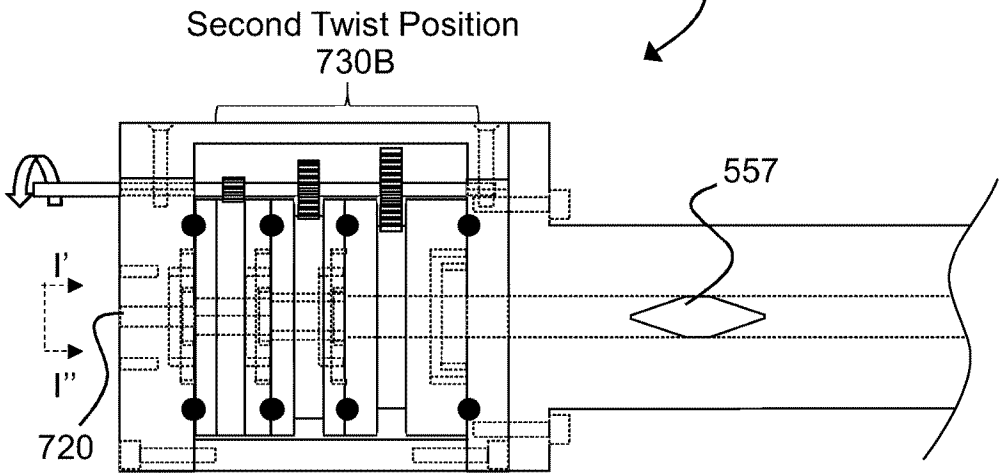
FIG. 8A is an illustrative cross-sectional view of a polarization step switching system in a second twist position according to embodiments.
Figure 8B:
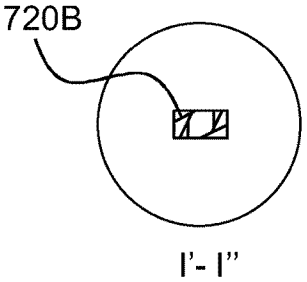
FIG. 8B is an illustrative front view across section line I-I' of the polarization step switching system shown in FIG. 8A.

Referring to FIG. 8A, an illustrative cross-sectional view of a polarization step switching system 700 is shown in a second twist position according to embodiments. FIG. 8B is an illustrative cross-sectional view across section line I-I' of the polarization step switching system 700 shown in FIG. 8A. In a second twist position, step twist segments across a section 730B are in second twisted position (see, e.g., FIG. 10C showing an illustrative perspective view of step twist segments in a second twisted state). The view 730B through IO port 720 thus appears to gradually transition to a second twisted position (as viewed through twisted segments). As described herein, the gradual twisting rotates an RF signal in the desired manner to change the linear polarization of the incoming signal delivered to the vane polarizer to effect final circular polarization of the signal transmitted out of the feed horn.

Figure 9A:
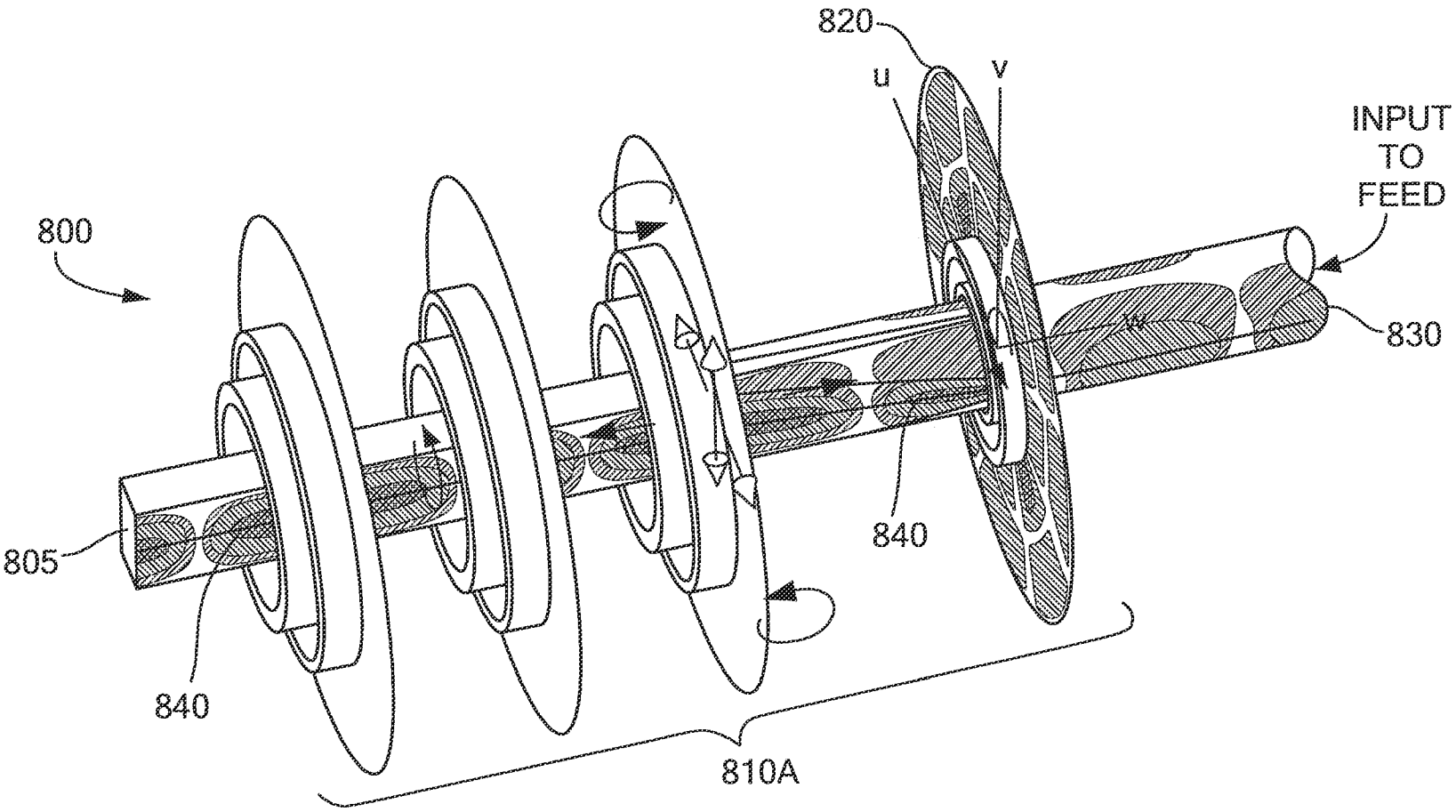
FIG. 9A is an illustrative perspective inverted internal view of a polarization step switching system in a first twist position according to embodiments.

Referring to FIG. 9A, an illustrative perspective inverted internal view of a polarization step switching system 800 in a first twist position is shown according to embodiments.

Figure 9B:
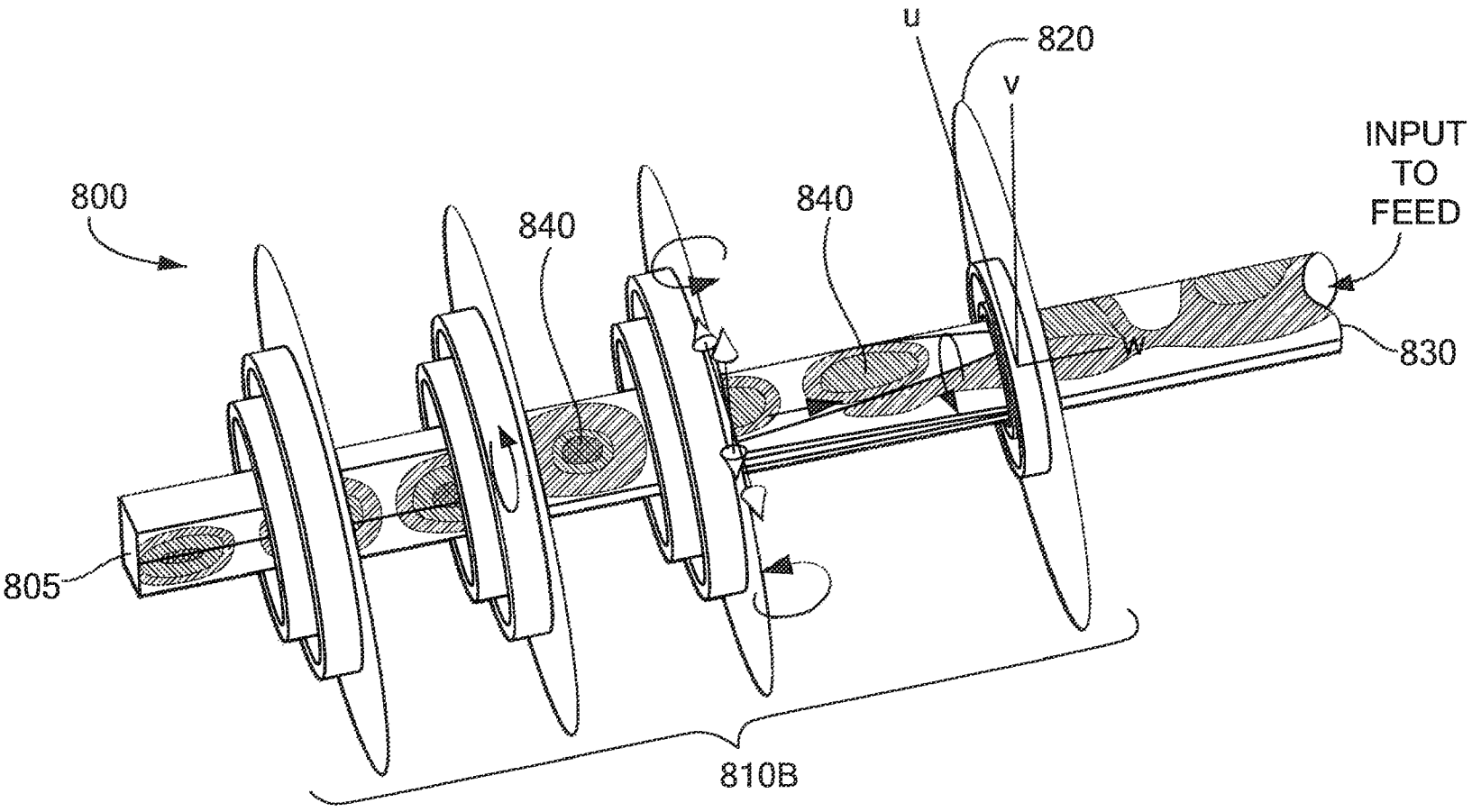
FIG. 9B is an illustrative perspective inverted internal view of a polarization step switching system in a second twist position according to embodiments.

FIG. 9B is an illustrative perspective inverted internal view of a polarization step switching system 800 in a second twist position according to embodiments. In embodiments, the solid appearing portions represent open air while the open portions represent solid material (e.g., metal). Three rotatable step switch sections are in an untwisted position 810A such that an RF signal entering at an IO port 805 is polarized to provide a linearly polarized signal at a port 830 such as further described herein. A corresponding intensity of an electric field is illustratively distinguished such as by intensity zones 840, showing the change in linear polarization of the signal in the circular output 830 of FIG. 9A versus 9B. In a second twist position 810B of the rotatable step switch sections, an incoming RF signal at port 805 is linearly polarized at 830, according to a target polarization state (e.g., right circularly polarized), and transmitted out at port 830 into the vane polarizer to affect the final circular polarization of the signal.

Figure 10A:
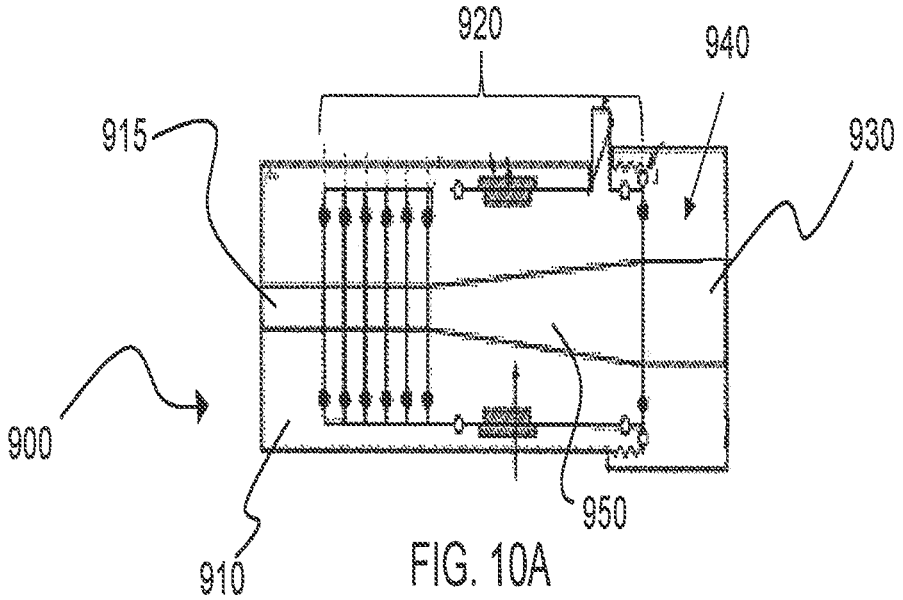
FIG. 10A is an illustrative cross-sectional view of a polarization step switching system according to embodiments.
Figures 10B, 10C:
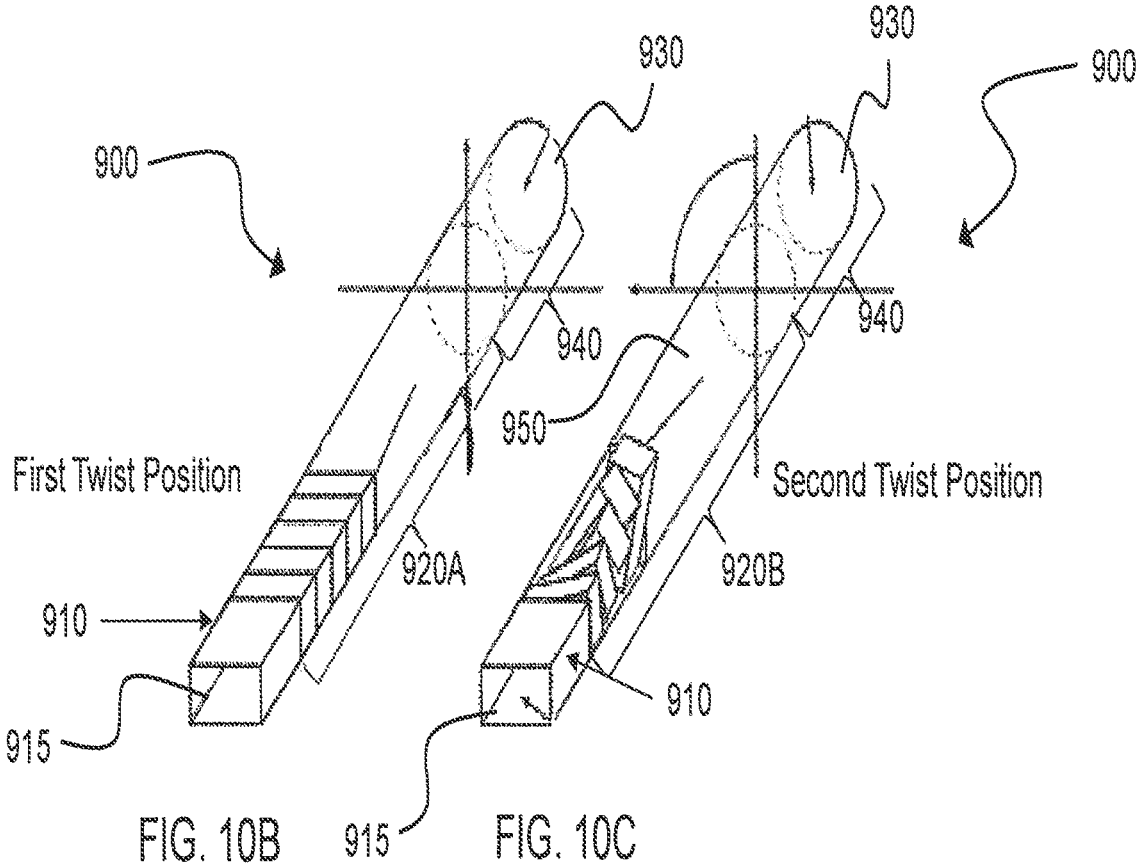
FIG. 10B is an illustrative perspective view of a polarization step switching system in a first twist position according to embodiments.
FIG. 10C is an illustrative perspective view of a polarization step switching system in a second twist position according to embodiments.

Referring to FIG. 10A, an illustrative cross-sectional view of a polarization step switching system 900 is shown according to embodiments. FIG. 10B is an illustrative perspective view of a polarization step switching system 900 in a first twist position according to embodiments. FIG. 10C is an illustrative perspective view of a polarization step switching system 900 in a second twist position according to embodiments. An input port 915 is provided at a stationary segment 910, which is coupled to rotatable ("twistable") segments of section 920, which is further coupled to a stationary section 940A transition section 950 gradually transitions from a rectangular-shaped waveguide to a circular-shaped output port 930. Circular port 930 can lead to a feed structure such as further described herein. Twistable segments are shown in the first untwisted position across a section 920A and in a second twisted position across a section 920B.

Elements of different embodiments described herein may be combined to form other embodiments not specifically set forth above. Other embodiments not specifically described herein are also within the scope of the following claims.

Reference herein to "one embodiment" or "an embodiment" means that a particular feature, structure, or characteristic described in connection with the embodiment can be included in at least one embodiment of the claimed subject matter. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the words "exemplary" and "illustrative" are used herein to mean serving as an example, instance, or illustration. Any aspect or design described herein as "exemplary" or "illustrative" is not necessarily to be construed as preferred or advantageous over other aspects or designs. Rather, use of the words "exemplary" and "illustrative" is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

To the extent directional terms are used in the specification and claims (e.g., upper, lower, parallel, perpendicular, etc.), these terms are merely intended to assist in describing the embodiments and are not intended to limit the claims in any way. Such terms, do not require exactness (e.g., exact perpendicularity or exact parallelism, etc.), but instead it is intended that normal tolerances and ranges apply. Similarly, unless explicitly stated otherwise, each numerical value and range should be interpreted as being approximate as if the word "about", "substantially" or "approximately" preceded the value of the value or range.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements. Signals and corresponding nodes or ports may be referred to by the same name and are interchangeable for purposes here.

As used herein in reference to an element and a standard, the term "compatible" means that the element communicates with other elements in a manner wholly or partially specified by the standard, and would be recognized by other elements as sufficiently capable of communicating with the other elements in the manner specified by the standard. The compatible element does not need to operate internally in a manner specified by the standard.

It will be further understood that various changes in the details, materials, and arrangements of the parts that have been described and illustrated herein might be made by those skilled in the art without departing from the scope of the following claims.

The invention claimed is:

1. A polarizer apparatus for RF communications comprising:

a waveguide step twist switch having a first port with a rectangular waveguide shape, and a second port having a circular waveguide shape, said waveguide switch comprising:

a plurality of rotatable disks coupled and arranged between the input and output of said waveguide switch, each of the disks having an opening provided therein which defines at least a portion of a signal path configured to allow RF signals to propagate therethrough;

an actuating mechanism arranged to rotate the disks to positions relative to each other which modify the polarization of RF signals propagating through the openings; and a feed coupled to the output of the step twist switch, the feed comprising a vane polarizer arranged to provide an output polarization of signals provided thereto from the output of the waveguide switch;

wherein different arrangements of the disks create different polarizations for different bands of RF frequencies.

2. The polarizer apparatus of claim 1, wherein the disks further comprise RF chokes arranged about the openings.

3. The polarizer apparatus of claim 1, wherein the actuating mechanism engages a series of coupled gears, wherein in response to a movement of said actuating mechanism, each of the gears rotates a corresponding disk at a different degree of rotation.

4. A polarizer apparatus for RF communications comprising:

a waveguide step twist switch having a first port with a rectangular waveguide shape, and a second port having a circular waveguide shape, said waveguide switch comprising:

a plurality of rotatable disks coupled and arranged between the input and output of said waveguide switch, each of the disks having an opening provided therein which defines at least a portion of a signal path configured to allow RF signals to propagate therethrough;

an actuating mechanism arranged to rotate the disks to positions relative to each other which modify the polarization of RF signals propagating through the openings; and a feed coupled to the output of the step twist switch, the feed comprising a vane polarizer arranged to provide an output polarization of signals provided thereto from the output of the waveguide switch;

wherein the output polarization of signals is at least one of left hand circular polarization or right hand circular polarization.

5. The polarizer apparatus of claim 4, wherein the actuating mechanism engages a series of coupled gears, wherein in response to a movement of said actuating mechanism, each of the gears rotates a corresponding disk at a different degree of rotation.

6. The polarizer apparatus of claim 4, wherein the disks further comprise RF chokes arranged about the openings.

7. A polarizer apparatus for RF communications comprising:

a waveguide step twist switch having a first port with a rectangular waveguide shape, and a second port having a circular waveguide shape, said waveguide switch comprising:

a plurality of rotatable disks coupled and arranged between the input and output of said waveguide switch, each of the disks having an opening provided therein which defines at least a portion of a signal path configured to allow RF signals to propagate therethrough;

an actuating mechanism arranged to rotate the disks to positions relative to each other which modify the polarization of RF signals propagating through the openings; and a feed coupled to the output of the step twist switch, the feed comprising a vane polarizer arranged to provide an output polarization of signals provided thereto from the output of the waveguide switch;

wherein the disk openings are provided having a rectangular shape.

8. The polarizer apparatus of claim 7, wherein the disks further comprise RF chokes arranged about the openings.

9. The polarizer apparatus of claim 7, wherein the actuating mechanism engages a series of coupled gears, wherein in response to a movement of said actuating mechanism, each of the gears rotates a corresponding disk at a different degree of rotation.

10. A polarizer apparatus for RF communications comprising:

a waveguide step twist switch having a first port with a rectangular waveguide shape, and a second port having a circular waveguide shape, said waveguide switch comprising:

a plurality of rotatable disks coupled and arranged between the input and output of said waveguide switch, each of the disks having an opening provided therein which defines at least a portion of a signal path configured to allow RF signals to propagate therethrough;

an actuating mechanism arranged to rotate the disks to positions relative to each other which modify the polarization of RF signals propagating through the openings; and a feed coupled to the output of the step twist switch, the feed comprising a vane polarizer arranged to provide an output polarization of signals provided thereto from the output of the waveguide switch;

wherein one of the rotating disks comprises a transition section that transitions substantially smoothly along its length from a rectangular input to a circular output.

11. The polarizer apparatus of claim 10, wherein the disks further comprise RF chokes arranged about the openings.

12. The polarizer apparatus of claim 10, wherein the actuating mechanism engages a series of coupled gears, wherein in response to a movement of said actuating mechanism, each of the gears rotates a corresponding disk at a different degree of rotation.

13. A polarizer apparatus for RF communications comprising:

a waveguide step twist switch having a first port with a rectangular waveguide shape, and a second port having a circular waveguide shape, said waveguide switch comprising:

a plurality of rotatable disks coupled and arranged between the input and output of said waveguide switch, each of the disks having an opening provided therein which defines at least a portion of a signal path configured to allow RF signals to propagate therethrough;

an actuating mechanism arranged to rotate the disks to positions relative to each other which modify the polarization of RF signals propagating through the openings; and a feed coupled to the output of the step twist switch, the feed comprising a vane polarizer arranged to provide an output polarization of signals provided thereto from the output of the waveguide switch;

wherein the disk openings can be rotated to gradually transition by about ninety degrees between a proximate disk opening and a distal disk opening.

14. The polarizer apparatus of claim 13, wherein the disks further comprise RF chokes arranged about the openings.

15. The polarizer apparatus of claim 13, wherein the actuating mechanism engages a series of coupled gears, wherein in response to a movement of said actuating mechanism, each of the gears rotates a corresponding disk at a different degree of rotation.

16. A rotating step twist waveguide, the rotating step twist waveguide comprising:

a first stationary rectangular waveguide section having a first end corresponding to an input port of the rotating step twist waveguide and a second end;

a first twist rectangular waveguide section having a first end coupled to the second end of said first stationary rectangular waveguide section and having a second end;

an intermediate twist rectangular waveguide section having a first end coupled to the second end of said first twist rectangular waveguide section and having a second end;

a distal twist rectangular to circular waveguide transition having a first end coupled to the second end of said intermediate twist rectangular waveguide section and having a second end; and a stationary circular waveguide section having a first end coupled to the second end of said distal twist rectangular to circular waveguide transition and having a second end corresponding to an output;

wherein the output is coupled to a feed structure comprising a vane polarizer.

17. The rotating step twist waveguide of claim 16, wherein the vane polarizer is arranged to provide an output polarization of signals provided thereto.

18. The rotating step twist waveguide of claim 17, wherein the output polarization of signals is at least one of left hand circular polarization or right hand circular polarization.

19. A method for polarizing RF communication signals comprising:

providing a waveguide switch having a first port with a rectangular waveguide shape, and a second port having a circular waveguide shape, said waveguide switch comprising a plurality of rotatable disks coupled and arranged between the input and output of said waveguide switch, each of the disks having an opening provided therein which defines at least a portion of a signal path configured to allow RF signals to propagate therethrough;

providing a feed coupled to the output of the waveguide switch, the feed comprising a vane polarizer arranged to provide circular polarization of signals provided thereto from the output of the waveguide switch;

receiving an input RF signal through the input of the waveguide switch;

based upon the type of input RF signal and a targeted polarization of an output signal, arranging the plurality of rotatable disks to one of a plurality of step switch rotations through which the input RF signal is configured to propagate through; and transmitting an output RF signal of the targeted polarization from the output of the waveguide switch;

wherein different arrangements of the disks polarize different bands of RF frequencies.

20. The method of claim 19, wherein the disks further comprise RF chokes arranged about the gaps between the disks.

21. The method of claim 19, wherein the actuating mechanism engages a series of coupled gears, wherein in response to a movement of said actuating mechanism, each of the gears rotates a corresponding disk at a different degree of rotation.

22. A method for polarizing RF communication signals comprising:

providing a waveguide switch having a first port with a rectangular waveguide shape, and a second port having a circular waveguide shape, said waveguide switch comprising a plurality of rotatable disks coupled and arranged between the input and output of said waveguide switch, each of the disks having an opening provided therein which defines at least a portion of a signal path configured to allow RF signals to propagate therethrough;

providing a feed coupled to the output of the waveguide switch, the feed comprising a vane polarizer arranged to provide circular polarization of signals provided thereto from the output of the waveguide switch;

receiving an input RF signal through the input of the waveguide switch;

based upon the type of input RF signal and a targeted polarization of an output signal, arranging the plurality of rotatable disks to one of a plurality of step switch rotations through which the input RF signal is configured to propagate through; and transmitting an output RF signal of the targeted polarization from the output of the waveguide switch;

wherein the disk openings are provided having a rectangular shape.

23. The method of claim 22, wherein the rectangular shape transitions substantially smoothly across a portion of its length to a circular shape at the output of the waveguide switch.

24. The method of claim 22, wherein different arrangements of the disks polarize different bands of RF frequencies.

25. A method for polarizing RF communication signals comprising:

providing a waveguide switch having a first port with a rectangular waveguide shape, and a second port having a circular waveguide shape, said waveguide switch comprising a plurality of rotatable disks coupled and arranged between the input and output of said waveguide switch, each of the disks having an opening provided therein which defines at least a portion of a signal path configured to allow RF signals to propagate therethrough;

providing a feed coupled to the output of the waveguide switch, the feed comprising a vane polarizer arranged to provide circular polarization of signals provided thereto from the output of the waveguide switch;

receiving an input RF signal through the input of the waveguide switch;

based upon the type of input RF signal and a targeted polarization of an output signal, arranging the plurality of rotatable disks to one of a plurality of step switch rotations through which the input RF signal is configured to propagate through; and transmitting an output RF signal of the targeted polarization from the output of the waveguide switch;

wherein the rectangular openings are arranged to gradually transition by about ninety degrees between a proximate disk opening and a distal disk opening.

26. The method of claim 25, wherein the disk openings are provided having a rectangular shape, the rectangular shape transitions substantially smoothly across a portion of its length to a circular shape at the output of the waveguide switch.

27. The method of claim 25, wherein the disks further comprise RF chokes arranged about the gaps between the disks.

* * * * *